United States Patent [19]

Elia

[11] Patent Number: 4,572,531

[45] Date of Patent: Feb. 25, 1986

[54] SNOW PLOW DOLLY

[76] Inventor: Thomas L. Elia, 2915 Scott Ave., McHenry, Ill. 60050

[21] Appl. No.: 621,172

[22] Filed: Jun. 15, 1984

[51] Int. Cl.[4] ..... B62B 5/00

[52] U.S. Cl. ..... 280/62; 280/79.1 A

[58] Field of Search ..... 280/47.13 R, 79.1 R, 280/79.1 A, 79.3, 62, 638

[56] References Cited

U.S. PATENT DOCUMENTS 2,375,363 5/1945 Hokanson ..... 211/13

3,941,400 3/1976 Buttner ..... 280/79.1 A 4,302,023 11/1981 Hiesz ..... 280/79.3

*Primary Examiner*—David M. Mitchell

*Assistant Examiner*—Richard M. Camby

*Attorney, Agent, or Firm*—Mathew R. P. Perrone, Jr.

[57] ABSTRACT

A dolly for a snow plow blade is in a generally T-shaped configuration wherein the base of the T is easily dismounted for storage of the dolly. The T-shaped dolly has a wheel secured to each end of the cross piece and the base piece.

20 Claims, 4 Drawing Figures

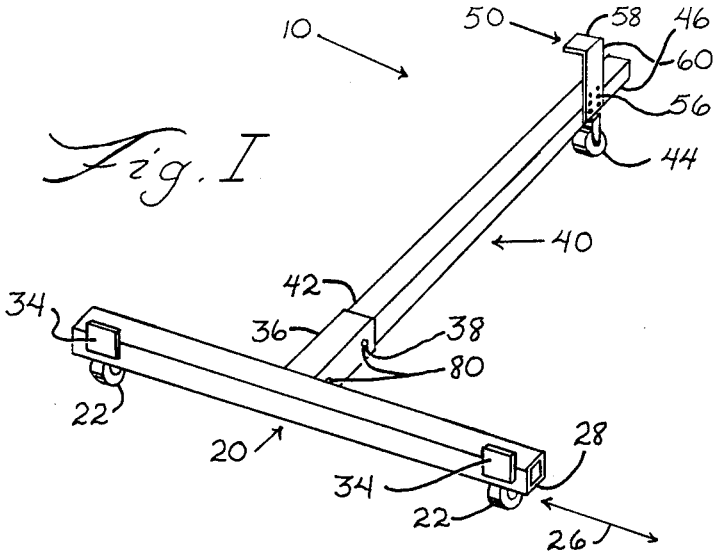
Fig. I
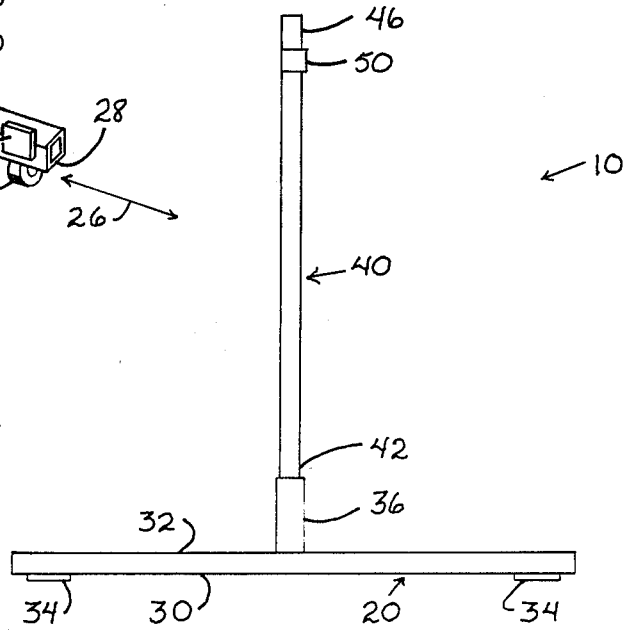
Fig II
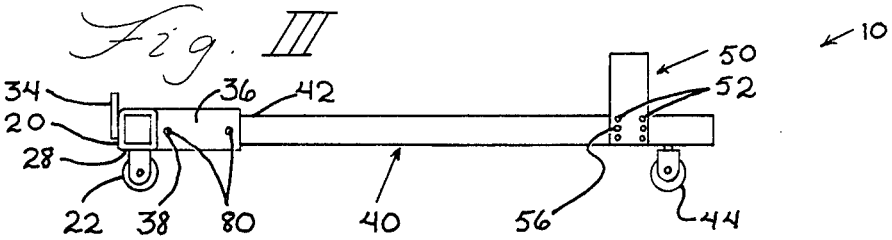
Fig. III
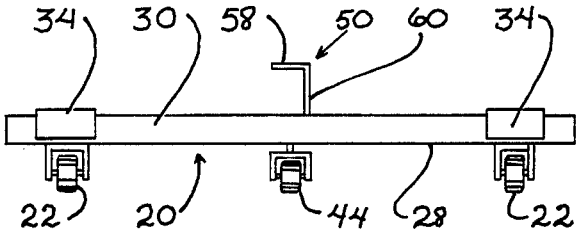
Fig. IV

SNOW PLOW DOLLY

BACKGROUND OF THE INVENTION

This invention relates to a device which assists in the mounting of a plow on a vehicle and more specifically to a dolly designed to support and render a snow plow blade easily movable.

In the northern parts of the United States, snow fall can be quite heavy. With the heavy snow fall, comes the opportunity to provide services by removing snow from roads, driveways and other arteries; and profit by providing the services. For this purpose, it is quite common for a person to purchase a four wheel drive vehicle and have a snow plow blade installed on the vehicle. This combination of equipment renders it possible for many people to keep their own arteries clear and possibly make a living plowing arteries of others.

There are howev. · several problems with this endeavor. For example, the smaller plows used in these businesses weigh in excess of 500 pounds. Thus, it becomes clearly a problem to move—let alone mount—the particular plows on the vehicles. It clearly requires the efforts of at least two persons to mount the plow on the vehicle. It is also difficult to remove the plow from the vehicle.

It thus becomes common to leave the snow plow on the vehicle during the period of time when snow is extremely likely to fall. In fact, most people install the plow at the beginning of the winter and remove it at the end. This long period of installation creates a substantial number of problems, while supposedly solving the problem of storage of the blade.

There are many disadvantages to this extended installation. The great weight of the plow, which is required for the snow plow to be effective, causes an extra burden on the front end of the vehicle. For example, the front tires and bearings of the vehicle, together will all of the other component parts of the frontend, wear out much more quickly than similar parts of a vehicle not carrying a plow blade.

Therefore, it is clearly desirable to provide a device, which will permit a snow plow blade to be installed and removed more easily. Design of such a device is very difficult. Different brands of plows are available. Different vehicles have different heights and require flexibility for installation. The differences in the vehicles and the plows compound the problems of making a device to assist in the mounting and removal of a blade. Thus, the required flexibility in the device causes substantial problems—the solution of one problem adding to the other problem.

Thus, it may be seen that it is extremely desirable to prepare a blade mounting device for use with a multiplicity of vehicles while at the same time making the device capable of permitting easier installation and removal of the blades.

SUMMARY OF THE INVENTION

Therefore, it is an object of this invention to provide for a device which will simplify the installation of a snow plow blade on a vehicle.

A further object of the invention is to provide a device which simplifies removal of the snow plow blade from a vehicle.

A still further object of the invention is to provide a device which permits the snow plow blade to be moved easily.

Yet a further object of the invention is to provide a device which permits the snow plow blade to be stored easily.

Also an object of this invention is to provide a device which is adjustable to compensate for different types of vehicles.

Another object of this invention is to provide a device which accommodates different styles of blades.

Still another object of this invention is to provide a device which minimizes wear on the front tires of the vehicle.

Yet another object of this invention is to provide a device which minimizes wear on the front bearings of the vehicle.

A further object of the invention is to provide a device which minimizes wear on the component parts of a vehicle front end.

These and other objects of the invention are met by providing a dolly for a snow plow blade in a generally T-shaped configuration wherein the base of the T is easily dismounted for storage of the dolly. The T-shaped dolly has a wheel secured to each end of the cross piece and the base of the leg.

BRIEF DESCRIPTION OF THE DRAWINGS

FIG. I depicts a perspective view of T-shaped snow plow dolly 10 of this invention.

FIG. II depicts a top view of FIG. I.

FIG. III depicts a side view of FIG. I showing a side view of base piece 20.

FIG. IV depicts an end view of FIG. I showing a side view of cross piece 20.

Throughout the Figures of the Drawings, where the same part appears in more than one Figure, the same number is given thereto.

DESCRIPTION OF THE PREFERRED EMBODIMENTS

A T-shaped dolly having a castor at the base of the T and a wheel at each end of the cross of the T provides for a device capable of receiving snow plow blade to be held in position for easy mounting and removal from a vehicle.

Referring now to FIG. I which is a perspective view of the dolly 10 of the invention, it becomes clear that dolly 10 of the invention is generally T-shaped and includes a cross piece 20 and a base piece 40 substantially centrally secured to cross piece 20. Adjacent each end of the cross piece 20, are wheels 22 secured to the cross piece 20. The wheels 22 may be castors and rotated about a vertical axis 24 and a horizontal axis 26 to achieve desired swivel characteristics. However, wheels rotating only about a horizontal axis are preferred for ease of steering the dolly 10.

Dolly 10 may be made from metal stock having a hollow square or hollow rectangular cross-section; or any other suitable cross-section. Other suitable cross-sections may be circular or elliptical. Wheels 22 are, of course, on the bottom 28 of cross piece 20. Assuming a rectangular cross-section, cross piece 20 includes an outer vertical side 30 oppositely disposed from base piece 40, and inner vertical side 32 adjacent base piece 40. On outer vertical side 30 and secured thereto are plow rests 34. Each of plow rests 34 is adjacent the location of a wheel 22. Plow rests 34 provide a place for resting the blade (not shown) on dolly 10.

Centrally secured to cross piece 20 on inner vertical side 32 is base receiver 36. Base receiver 36 has a structure similar cross piece 20, and includes cross apertures 38 in the vertical sides thereof so that base piece 40 may be secured to cross piece 20 by bolting or similar means.

The mounting arm of the blade rests on base piece 40. At a cross end 42 (adjacent cross piece 20) of base piece 40, base piece 40 fits into base receiver 36 in a preferred fashion. Base piece 40 can be secured to cross piece 20 in any suitable fashion. Base piece 40 is slidably mounted within base receiver 36 and includes base apertures 56, so that base piece 40 may be secured therein by bolts 80.

Oppositely disposed from cross piece 20 on base piece 40 is base castor 44 on the same side as wheels 22. Base castor 44 is secured to castor end 46 of base piece 40. Castor end 46 is oppositely disposed from cross end 42 of base piece 40. Adjacent base castor 44 is mounting support 50. Mounting support 50 is secured to base piece 40 in an adjustable fashion by a plurality of mounting apertures 52 in mounting support 50. Mounting apertures 52 line-up with base apertures 56 to secure mounting support 50 to base piece 40.

The top view of dolly 10 in FIG. II more clearly emphasizes the relative positions of cross piece 20, base piece 40, mounting support 50, plow rest 34, and base receiver 36.

The side view of dolly 10 in FIG. III more clearly emphasizes the relative positions of wheel 22, base castor 44, and mounting support 50.

Mounting support 50 is shown in FIG. IV to have a blade mount receiver 58 at a right angle connecting arm 60. Connecting arm 60 includes the plurality of height adjusting mounting apertures 52 (shown in FIG. III) of mounting support 50. Blade mount receiver 58 is thus adaptable for the various vehicles and the height of the respective mounting apparatus.

In this fashion, mounting support 50 can be adjusted in height to compensate for the vehicle on which the blade is to be installed. The use of the castors in the various mounting procedures permits the blade to be handled and mounted by one man in much less time than two men can do it.

The following examples are offered for the purpose of illustrating the disclosed and claimed invention. The specification and claims are to be taken as a whole, without drawing undue limitations thereon from the instant examples.

EXAMPLE ONE

Two men using a Jeep Cherokee with a standard western plow mount already secured to the Jeep attempt to secure the plow blade to the plow mount. These men, being experienced in the field, take one half hour to complete mounting of the plow blade and render the Jeep thus ready to begin plowing the snow.

EXAMPLE TWO

The plow blade from the Jeep of Example One is mounted on the dolly 10 of the invention. The blade rests against plow rests 34 while the mounting supports for blade rest against support rest 54. One of the men of example one steps aside and the other is permitted to mount the blade by himself. The dolly 10 with the blade thereon is wheeled into position and mounted on the Jeep in standard fashion in ten minutes.

Because of this disclosure and solely because of this disclosure, various modifications to snow plow dolly 10 will become clear to those having ordinary skill in the art. Such modifications are clearly covered hereby.

What is claimed and sought to be secured by Letters Patent of the United States is:

1. A dolly having a T-shape and being capable of receiving a snow plow blade to be held in position for easy mounting and removal from a vehicle includes a base piece secured to a cross piece to form said T-shape, wherein:

a. said cross piece and said base piece have a substantially rectangular cross-section;

b. said cross piece includes an outer vertical side oppositely disposed from said base piece and an inner vertical side adjacent said base piece;

c. a cross wheel is secured at each end of said cross piece and a base castor is secured to said base piece oppositely disposed from said cross piece, each of said cross wheels and said base castor being on a bottom side of said dolly;

d. a plow rest for receiving a snow plow blade is secured at each end of said cross piece on said outer vertical side;

e. one of said plow rest is secured adjacent each of said wheels on said cross piece;

f. a base receiver is secured to said inner vertical side at a central portion thereof in substantially perpendicular relationship therewith, said base receiver having a structure similar to said cross piece;

g. a pair of cross apertures are in the vertical sides of said base receiver;

h. said base piece has a pair of colinear base apertures in each vertical side thereof at a cross end of said base to match each pair of cross apertures;

i. said cross end is slideably mounted into base receiver and secured in base receiver by nut and bolt arrangements through said colinear base apertures and said cross apertures;

j. a base castor is mounted on said base on said bottom side of said dolly and oppositely disposed to said cross end of said base;

k. a mounting support is secured to said base adjacent said base castor by an adjustable fastening means;

l. said mounting support includes a plurality of mounting apertures;

m. said mounting apertures cooperate with base mounting apertures to secure said mounting support to said base piece by a nut and bolt arrangement; and n. said base mounting apertures are adjacent said base castor.

2. The dolly of claim 1 wherein two adjacent sides of said rectangular cross-section are equal.

3. The dolly of claim 2 wherein said mounting support is a flattened piece including a blade mount receiver at substantially a right angle to a connecting arm and said plurality of mounting apertures are within said connecting arm.

4. The dolly of claim 3 wherein said cross piece and said base piece are separable for storage or similar purposes; and said plow rests are welded to said cross piece on said outer vertical side.

5. A dolly having a T-shape and being capable of receiving a snow plow assembly, said snow plow assembly including a snow plow blade and a snow plow mounting assembly to be held in position for easy mounting and removal from a vehicle, and further including a base piece secured to a cross piece to form said T-shape having wheels at each end of said cross piece and a castor on said base piece, said castor being oppositely disposed from said cross piece, wherein:

a. a base receiver is secured to an inner side of said cross piece at a central portion thereof in substantially perpendicular relationship therewith, said base receiver having a cross-sectional shape similar to said base piece;

b. said cross piece receives said base piece at a central portion of said cross piece;

c. a securing means for removably joining said base piece to said cross piece;

d. a plow rest for said snow plow blade is secured to said cross piece; and e. an adjustable mounting support for said snow plow mounting assembly is secured to said base and oppositely disposed from said cross piece.

6. The dolly of claim 5 wherein a cross wheel is secured at each end of said cross piece; and a base castor is secured to said base piece oppositely disposed from said cross piece, each of said cross wheels and said base castor being on a bottom side of said dolly.

7. The dolly of claim 6 wherein said plow rest includes two support pieces, each of said support pieces being secured at opposing ends of said cross piece adjacent each of said cross wheels.

8. The dolly of claim 7 wherein: said base receiver has a structure similar to said cross piece.

9. The dolly of claim 8 wherein said securing means includes a pair of cross apertures that are in the vertical sides of said base receiver; and a pair of colinear base apertures in said base piece to match said cross apertures.

10. The dolly of claim 9 wherein a cross end of said base piece is slideably mounted into the base receiver and secured therein by a nut and bolt arrangements through said colinear base apertures and said cross apertures;

11. The dolly of claim 10 wherein:

a. said adjustable mounting support includes a plurality of mounting apertures;

b. said mounting apertures cooperate with base mounting apertures in said base piece to secure said mounting support to said base piece by a nut and bolt arrangement; and c. said base mounting apertures are adjacent said base castor.

12. The dolly of claim 11 wherein said mounting support is a flattened piece including a blade mount receiver at substantially a right angle to a connecting arm.

13. The dolly of claim 12 wherein said connecting arm includes said plurality of mounting apertures.

14. The dolly of claim 13 wherein each of said cross wheels is a castor.

15. The dolly of claim 14 wherein each of said cross wheels is fixed.

16. The dolly of claim 15 wherein the cross sections of said cross piece and said base piece are rectangular.

17. The dolly of claim 16 wherein two adjacent sides of said rectangular cross-section are equal.

18. The dolly of claim 16 wherein said cross sections are square.

19. The dolly of claim 16 wherein the cross sections of said cross piece and said base piece are elliptical.

20. The dolly of claim 16 wherein the cross sections of said cross piece and said base piece are circular.

* * * * *